United States Patent [19]

Rawlings

[11] Patent Number: 4,666,412

[45] Date of Patent: May 19, 1987

[54] MARINE ENGINE MOUNTING APPARATUS

[75] Inventor: David E. Rawlings, Palatine, Ill.

[73] Assignee: Outboard Marine Corporation, Waukegan, Ill.

[21] Appl. No.: 739,108

[22] Filed: May 30, 1985

[51] Int. Cl.[4] ..... B63H 5/12

[52] U.S. Cl. ..... 440/111; 248/635

[58] Field of Search ..... 440/111, 112, 53, 64; 248/635, 632, 638, 640

[56] References Cited

U.S. PATENT DOCUMENTS

| | | | |
|---|---|---|---|
| Re. 28,816 | 5/1976 | Lambrecht | 440/111 |
| 996,444 | 6/1911 | Yarrington | 440/111 |
| 2,046,558 | 7/1936 | Hussman | 440/111 |
| 3,259,099 | 7/1966 | Kiekhaefer | 440/111 |
| 3,772,456 | 3/1973 | Lambrecht | 440/111 |
| 3,845,923 | 11/1974 | Atkinson | 440/111 |
| 3,865,068 | 2/1975 | Haasl | 440/112 |
| 3,918,387 | 11/1975 | Jobst | 440/111 |
| 3,929,089 | 12/1975 | Lambrecht | 440/111 |
| 4,003,330 | 1/1977 | Compton | 440/111 |
| 4,213,718 | 7/1980 | Lamby | 248/635 |
| 4,286,777 | 9/1981 | Brown | 248/635 |
| 4,306,708 | 7/1981 | Gassaway | 267/141.3 |

FOREIGN PATENT DOCUMENTS

| | | | |
|---|---|---|---|
| 2856604 | 7/1980 | Fed. Rep. of Germany | 440/111 |

*Primary Examiner*—Sherman D. Basinger
*Assistant Examiner*—C. T. Bartz
*Attorney, Agent, or Firm*—Michael, Best & Friedrich

[57] ABSTRACT

A marine propulsion installation comprising a propulsion unit including a rotatably mounted propeller and being adapted to be mounted on the transom of a boat, an engine drivingly connected to the propeller, an engine support fixedly connected to the engine and having a slot open at one end, a support member adapted to be mounted on the hull of the boat, a resilient mounting assembly connected to the support member, a bolt connected to the mounting assembly and received in the slot, and a washer operative between the bolt and the engine support for preventing removal of the bolt from the slot.

15 Claims, 4 Drawing Figures

MARINE ENGINE MOUNTING APPARATUS

BACKGROUND OF THE INVENTION

The invention relates to mounting apparatus for marine engines, and more particularly to apparatus for mounting an inboard engine on the transom of a boat.

It is known in the art to use resilient means to mount an inboard engine to the transom plate of a stern drive unit. For example, it is known to have a projection extending forwardly from the transom plate, a projection extending rearwardly from the engine and having therein a vertical bore, a resilient mounting assembly connected to the transom plate projection, a bolt inserted through the resilient mounting assembly and the bore in the engine projection, and a nut on the end of the bolt to secure the engine projection to the mounting assembly and to the transom plate projection.

This prior mounting apparatus requires alignment of the engine projection vertical bore with the mounting assembly and then insertion of the bolt through the mounting assembly and the vertical bore in order to mount the engine on the transom plate. This can be very difficult.

Attention is directed to the following U.S. patents which disclose mounting apparatus:

Kiekhaefer: U.S. Pat. No. 3,259,099, July 5, 1966
Lambrecht: U.S. Pat. No. 3,929,089, Dec. 30, 1975
Lambrecht: U.S. Pat. Re. No. 28,816, May 18, 1976
Haasl: U.S. Pat. No. 3,865,068, Feb. 11, 1975
Hussman: U.S. Pat. No. 2,046,558, July 7, 1936
Brown: U.S. Pat. No. 4,286,777, Sept. 1, 1981
Lamby: U.S. Pat. No. 4,213,718, July 22, 1980
Gassaway: U.S. Pat. No. 4,306,708, Dec. 22, 1981
Compton: U.S. Pat. No. 4,003,330, Jan. 18, 1977
Jobst: U.S. Pat. No. 3,918,387, Nov. 11, 1975

SUMMARY OF THE INVENTION

The invention provides a marine propulsion installation comprising a propulsion unit including a rotatably mounted propeller and being adapted to be mounted on the transom of a boat, an engine drivingly connected to the propeller and including a fixedly extending support arm having a slot open at one end, a support member adapted to be mounted on the hull of the boat, a resilient mounting assembly, means connecting the mounting assembly to the support member, projection means connected to the mounting assembly and received in the slot in the support arm, and means operative between the projection means and the support arm for preventing removal of the projection means from the slot.

The invention also provides a marine engine mounting apparatus comprising a support arm adapted to be connected to a marine engine, a support member adapted to be mounted on a boat hull, one of the support arm and the support member having a slot open at one end, a resilient mounting assembly connected to the other of the support arm and the support member, a stud extending from the mounting assembly and received in the slot, and means on the stud and on the one of the support arm and the support member for preventing removal of the stud from the slot.

The invention also provides a marine engine mounting apparatus comprising a support arm adapted to be connected to a marine engine and having a slot open at one end, a support member adapted to be mounted on a boat hull, a resilient mounting assembly connected to the support member, a stud extending from the mounting assembly and received in the slot, and means on the stud and on the support arm for preventing removal of the stud from the slot.

The invention also provides a marine engine mounting apparatus comprising a transom plate adapted to be mounted on a boat transom, an engine support adapted to be connected to a marine engine and having a slot open at one end and a surface defining a recessed opening communicating with the slot, and means for resiliently connecting the engine support to the transom plate. The connecting means comprises a resilient mounting assembly connected to the transom plate, a washer received in the recessed opening, and means received in the slot for connecting the washer to the mounting assembly with the engine support therebetween so as to prevent displacement of the mounting assembly relative to the slot.

In one embodiment, the connecting means further includes means for releasably holding the washer in the recessed opening against movement toward the open end of the slot.

In one embodiment, the slot extends generally horizontally and the surface is generally horizontal.

In one embodiment, the recessed opening and the washer are circular.

The invention also provides a marine engine mounting apparatus comprising a transom plate adapted to be mounted on a boat transom, an engine support adapted to be connected to a marine engine and including a generally horizontally extending arm having therein a horizontally extending slot open at one end and having upper and lower portions, the arm also having an upper surface defining a recessed opening communicating with the slot, and means for mounting the engine support on the transom plate. The mounting means includes a resilient mounting assembly connected to the transom plate, a bolt extending through the mounting assembly and having a first end with a head and a second end projecting vertically from the mounting assembly and received in the slot and in the recessed opening, a nut on the second end of the bolt so that the bolt is fixed against axial movement relative to the mounting assembly by the nut and the head of the bolt, the nut including generally parallel sides and being received in the lower portion of the slot so that the nut is fixed against rotation relative to the arm, a washer slidably mounted on the bolt and received in the recessed opening, and means releasably holding the washer in the recessed opening and on the bolt so that the arm is fixed against movement relative to the mounting assembly.

In one embodiment, the releasably holding means comprises a second nut on the bolt.

In one embodiment, the resilient mounting assembly comprises a plate attached to the transom plate, spaced upper and lower washers on the bolt, a conical core having a generally vertical bore receiving the bolt between the spaced upper and lower washers, and an elastomeric member connected to the plate and to the core.

In one embodiment, the upper and lower washers are held between the nut and the head.

In one embodiment, the upper portion of the slot has a width, and the lower portion of the slot has a width greater than the width of the upper portion.

A principal feature of the invention is the provision of a marine engine mounting apparatus comprising, in part, an engine support having a slot open at one end, projection means connected to a resilient mounting assembly and received in the slot, and means operative between the projection means and the engine support for preventing removal of the projection means from the slot. Preferably, the projection means is a bolt or stud, the support arm includes a recessed opening communicating with the slot, and the means operative between the bolt and the engine support includes a washer slidably mounted on the end of the bolt and received in the recessed opening. The means operative between the bolt and the engine support preferably further includes a nut on the end of the bolt for releasably holding the washer in the recessed opening so that the engine support is fixed against movement relative to the mounting assembly. While providing secure positioning of the engine once mounting is completed, this construction facilitates mounting of the engine by allowing the engine to be rearwardly slid into its mounted position.

Other features and advantages of the invention will become apparent to those skilled in the art upon review of the following detailed description, claims, and drawings.

Figure 1:
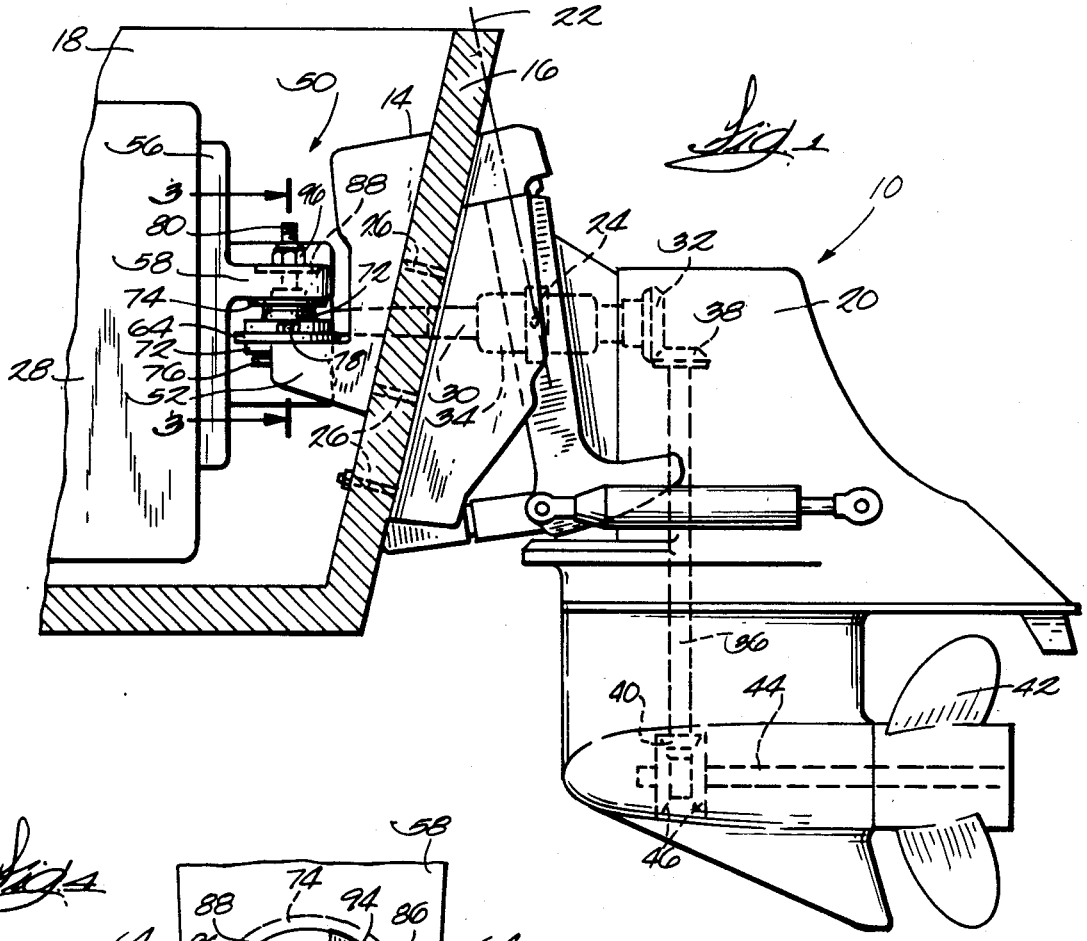
FIG. 1 is a side elevational view of a marine propulsion installation embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion installation 10 embodying the invention is shown in the drawings. As best shown in FIG. 1, the marine propulsion installation 10 includes a support member or transom plate 14 mounted on the inside of the transom 16 of a boat 18, and a propulsion unit 20 mounted on the outside of the transom 16 for pivotal movement relative to the transom 16 about a generally vertical steering axis 22, and about a generally horizontal tilt axis 24. In the illustrated construction, the transom plate 14 and propulsion unit 20 are mounted on the transom 16 by a plurality of bolts 26 extending through the transom 16. The marine propulsion installation 10 also includes an engine 28 mounted inside the boat 18.

In the preferred embodiment, the propulsion unit 20 includes a generally horizontal drive shaft 30 having one end driven by the engine 28, and an opposite end having thereon a bevel gear 32. A universal joint attached to the horizontal drive shaft 30 allows pivotal movement of the horizontal drive shaft 30 with the propulsion unit 20. The propulsion unit 20 also includes a generally vertical drive shaft 36 having an upper end having thereon a bevel gear 38 driven by the bevel gear 32, and a lower end having thereon a bevel gear 40. The propulsion unit 20 further includes a propeller 42 rotatably mounted on a propeller shaft 44, and a reversible transmission (not shown) which selectively clutches a pair of driven gears 46 to the propeller shaft 44 to transmit forward or reverse motion to the propeller shaft 44 from the bevel gear 40.

Figure 4:
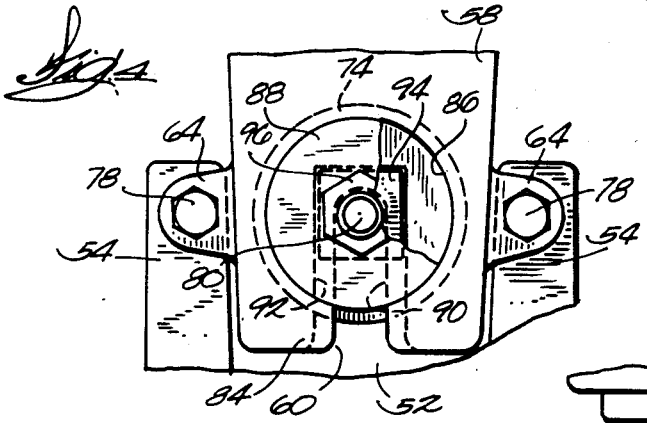
FIG. 4 is a partial, enlarged, top view of the mounting apparatus shown in FIG. 1.
Figure 2:
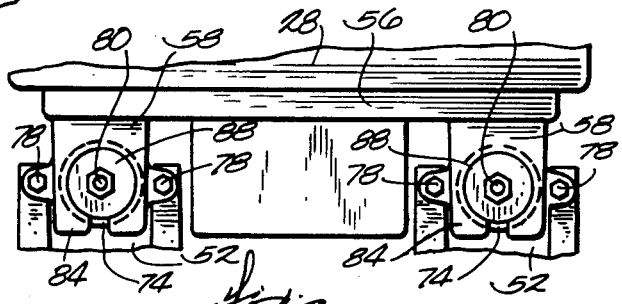
FIG. 2 is a top view of the mounting apparatus shown in FIG. 1.
Figure 3:
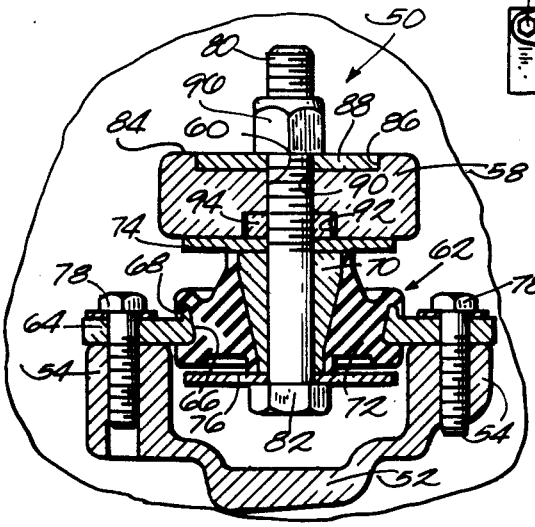
FIG. 3 is a cross-sectional view taken along line 3—3 in FIG. 1.

In the preferred embodiment, the marine propulsion installation 10 also includes a mounting apparatus 50 comprising, on the transom plate 14, a pair of laterally spaced, forwardly extending projections 52 each including a pair of laterally spaced, upwardly extending flanges 54 (FIGS. 3 and 4). The mounting apparatus 50 also comprises an engine support 56 fixedly connected to the rearward end of the engine 28 and including a pair of generally horizontally, rearwardly extending arms 58 each having therein a horizontally extending slot 60 (FIGS. 3 and 4) open at its rearward end.

The mounting apparatus 50 also comprises a pair of resilient mounting assemblies 62 (FIG. 3) each connected to one of the transom plate projections 52. Since the mounting assemblies 62 are substantially identical, only one will be described in detail.

While various suitable mounting assemblies can be used, in the preferred embodiment, the mounting assembly 62 includes a generally horizontal plate 64 having a centrally located aperture 66 (FIG. 3) forming an inner edge with a lip 68. The mounting assembly 62 further includes a conical core 70 having a generally vertical bore, and an elastomeric member 72 connecting the plate 64 and the core 70. In the illustrated construction, the elastomeric member 72 includes a central, conical aperture receiving the conical core 70, and the elastomeric member 72 is located in the central aperture 66 in the plate 64 and includes an annular groove receiving the inner edge and lip 68 of the plate 64. Preferably, the elastomeric member 72 is made of rubber and is bonded to both the conical core 70 and the plate 64. This mounting assembly 62 is conventional.

The mounting apparatus 50 preferably also comprises spaced upper and lower washers 74 and 76 positioned above and below the core 70, or so that the core 70 is positioned between the washers 74 and 76.

The mounting apparatus 50 further comprises means connecting the mounting assembly 62 to the transom plate projection 52. While various suitable connecting means can be employed, in the illustrated construction, the connecting means includes a pair of bolts 78 (FIGS. 3 and 4) inserted through the plate 64 and threaded into the flanges 54 of the transom plate projection 52.

The mounting apparatus 50 further comprises projection means connected to the mounting assembly 62 and received in the slot 60 in the engine support arm 58. While various suitable projection means can be used, in the preferred embodiment, the projection means includes a stud or bolt 80 extending through the washers 74 and 76 and the conical core 70 of the mounting assembly 62 and having a first or lower end with a head 82, and a second or upper end projecting vertically from the mounting assembly 62 and received in the slot 60.

The mounting apparatus 50 further comprises means operative between the bolt 80 and the engine support arm 58 for preventing removal of the bolt 80 from the slot 60. While various suitable means can be employed, in the preferred embodiment, the engine support arm 58 has an upper surface 84 defining a recessed opening 86 communicating with the slot 60, and the means operative between the bolt 80 and the support arm 58 includes a washer 88 slidably mounted on the upper end of the bolt 80 and received in the recessed opening 86 in the support arm 58. In the illustrated construction, both the washer 88 and the recessed opening 86 are circular. Thus, the bolt 80 is received in the slot 60 for connecting the washer 88 to the mounting assembly 62 with the engine support arm 58 therebetween so as to prevent displacement of the mounting assembly 62 relative to the slot 60.

In the preferred embodiment, the slot 60 has an upper portion 90 and a lower portion 92 having a width greater than the width of the upper portion 90. The mounting apparatus 50 preferably further comprises a nut 94 threaded onto the upper end of the bolt 80 against the upper washer 74 so that the bolt 80 is fixed against axial movement relative to the mounting assembly 62 by the nut 94 and the head 82 of the bolt 80. Preferably, the nut 94 is square and is received in the lower portion 92 of the slot 60 with two opposite or parallel sides of the nut 94 abutting the opposite walls of the slot 60 so that the nut 94 is fixed against rotation relative to the engine support arm 58.

The mounting apparatus 50 preferably further comprises means releasably holding the washer 88 in the recessed opening 86 and on the bolt 80 so that the engine support arm 58 is fixed against movement relative to the mounting assembly 62. While various suitable holding means can be used, in the illustrated construction, the holding means includes a second or locking nut 96 threaded onto the upper end of the bolt 80. When the locking nut 96 is tightened against the washer 88, movement of the washer 88 relative to the engine support arm 58 is substantially prevented, so that the washer 88 is held in the recessed opening 86. Additionally, when the locking nut 96 is tightened against the washer 88, axial movement of the bolt 80 and of the mounting assembly 62 relative to the engine support arm 58 is substantially prevented.

The forward end of the engine 28 can be mounted on the boat 18 by any suitable means, such as with mounting apparatus similar to the rearward mounting apparatus 50.

The rearward end of the engine 28 is mounted as follows. The bolt 80 is inserted into the mounting assembly 62 and the upper and lower washers 74 and 76, and is secured by the square nut 94. Also, the mounting assembly plate 64 is secured to the transom plate projection 52 by the bolts 78. Next, the engine support arm 58 is rearwardly slid over the bolt 80 with the slot 60 receiving the bolt 80, and with the lower portion 92 of the slot 60 receiving the square nut 94. Finally, the washer 88 is placed on the upper end of the bolt 80 and into the recessed opening 86, and the locking nut 96 is threaded onto the upper end of the bolt 80 and tightened against the washer 88. The square nut 94 prevents twisting of the elastomeric member 72 as the locking nut 96 is tightened.

It should be understood that in alternative embodiments of the invention the mounting assembly can be connected to the support arm and the slot can be in the transom plate projection. Also, the slot can be in the lower surface of the support arm or transom plate projection rather than in the upper surface. For example, referring to the illustrated construction, the bolt 80 can be received in a vertical bore (rather than the slot 60) in the support arm 58, and the bolts 78 can be received in slots in the transom plate projection 52.

Other features and advantages of the invention are set forth in the following claims.

I claim:

1. A marine propulsion installation comprising a propulsion unit including a rotatably mounted propeller and being adapted to be mounted on the transom of a boat, an engine drivingly connected to said propeller and including a fixedly extending support arm having a slot open at one end, a support member adapted to be mounted on the hull of the boat, a resilient mounting assembly, means connecting said mounting assembly to said support member, projection means connected to said mounting assembly and received in said slot in said support arm, and means operative between said projection means and said support arm and including a recess located in said support arm and communicating with said slot, and a part of said projection means and located in said recess for preventing removal of said projection means from said slot.

2. A marine engine mounting apparatus comprising a support arm adapted to be connected to a marine engine, a support member adapted to be mounted on a boat hull, one of said support arm and said support member having a slot open at one end, extending in a given direction, and having a width, a resilient mounting assembly connected to the other of said support arm and said support member, a stud extending from said mounting assembly and received in said slot, and means including a recess located on said one of said support arm and said support member having said slot, communicating with said slot, and having a dimension parallel to and greater than said width, and a part located on said stud, received in said recess, and having a dimension greater than said width, whereby to prevent removal in said given direction of said stud from said slot.

3. A marine engine mounting apparatus comprising a support arm adapted to be connected to a marine engine and having a slot open at one end, a support member adapted to be mounted on a ball hull, a resilient mounting assembly connected to said support member, a stud extending from said mounting assembly and received in said slot, and means including a recess located on said support arm and communicating with said slot, and a washer located on said stud and received in said recess for preventing removal of said stud from said slot.

4. A marine engine mounting apparatus comprising a transom plate adapted to be mounted on a boat transom, an engine support adapted to be connected to a marine engine and having a slot which is open at one end, which has a length, and which has a width, and a surface defining a recessed opening which communicates with said slot and which has a dimension parallel to and greater than said width of said slot, and means for resiliently connecting said engine support to said transom plate, said connecting means comprising a resilient mounting assembly connected to said transom plate, a part having a dimension greater than said width of said slot and received in said recessed opening, and means received in said slot for connecting said part to said mounting assembly with said engine support therebetween so as to prevent displacement, in the direction of said length, of said mounting assembly relative to said slot.

5. A marine engine mounting apparatus in accordance with claim 4 wherein said connecting means further includes means for releasably holding said washer in said recessed opening against movement toward said open end of said slot.

6. A marine engine mounting apparatus in accordance with claim 4 wherein said slot extends generally horizontally, and wherein said surface is generally horizontal.

7. A marine engine mounting apparatus in accordance with claim 4 wherein said recessed opening is circular, and wherein said washer is circular.

8. A marine engine mounting apparatus comprising a transom plate adapted to be mounted on a boat transom, an engine support adapted to be connected to a marine engine and including a generally horizontally extending arm having therein a horizontally extending slot open at one end and having upper and lower portions, said arm also having an upper surface defining a recessed opening communicating with said slot, and means for mounting said engine support on said transom plate and including a resilient mounting assembly connected to said transom plate, a bolt extending through said mounting assembly and having a first end with a head and a second end projecting vertically from said mounting assembly and received in said slot and in said recessed opening, a nut on said second end of said bolt so that said bolt is fixed against axial movement relative to said mounting assembly by said nut and said head of said bolt, said nut including generally parallel sides and being received in said lower portion of said slot so that said nut is fixed against rotation relative to said arm, a washer slidably mounted on said bolt and received in said recessed opening, and means releasably holding said washer in said recessed opening and on said bolt so that said arm is fixed against movement relative to said mounting assembly.

9. A marine engine mounting apparatus in accordance with claim 8 wherein said releasably holding means comprises a second nut on said bolt.

10. A marine engine mounting apparatus in accordance with claim 8 and further comprising spaced upper and lower washers on said bolt, wherein said resilient mounting assembly comprises a plate attached to said transom plate, a conical core having a generally vertical bore receiving said bolt between said spaced upper and lower washers, and an elastomeric member connected to said plate and to said core.

11. A marine engine mounting apparatus in accordance with claim 10 wherein said upper and lower washers are held between said nut and said head.

12. A marine engine mounting apparatus in accordance with claim 11 wherein said releasable holding means comprises a second nut on said bolt.

13. A marine engine mounting apparatus in accordance with claim 8 wherein said upper portion of said slot has a width, and wherein said lower portion of said slot has a width greater than the width of said upper portion.

14. A marine engine mounting apparatus in accordance with claim 8 wherein said recessed opening is circular, and wherein said washer is circular.

15. A marine engine mounting apparatus comprising a support arm adapted to be connected to a marine engine, a support member adapted to be mounted on a boat hull, one of said support arm and said support member having a slot open at one end, a resilient mounting assembly connected to the other of said support arm and said support member, a stud extending from said mounting assembly and received in said slot, and means including a recess located in said one of said support arm and said support member and communicating with said slot, and a part of said stud and located in said recess for preventing removal of said stud from said slot.

* * * * *